US006817606B2

(12) United States Patent
Goi et al.

(10) Patent No.: US 6,817,606 B2
(45) Date of Patent: Nov. 16, 2004

(54) PACKAGING MATERIAL OF PHOTOTHERMOGRAPHIC IMAGE RECORDING SHEET AND DETECTING METHOD OF PRESENCE/ABSENCE OF RESIDUAL PHOTOTHERMOGRAPHIC IMAGE RECORDING SHEET

(75) Inventors: Katsunori Goi, Tokyo (JP); Mamoru Umeki, Tokyo (JP); Wataru Tachikawa, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/236,519

(22) Filed: Sep. 6, 2002

(65) Prior Publication Data

US 2003/0049573 A1 Mar. 13, 2003

(30) Foreign Application Priority Data

Sep. 13, 2001 (JP) ..... 2001-277565

(51) Int. Cl.[7] ..... B65H 3/12
(52) U.S. Cl. ..... 271/94; 271/104; 271/107
(58) Field of Search ..... 271/9.03, 25, 31, 271/38, 110, 152, 104, 94, 96, 98, 107, 105, 106

(56) References Cited

U.S. PATENT DOCUMENTS 4,337,285 A * 6/1982 Akao et al. ..... 428/35.3
5,199,569 A * 4/1993 Di Pietro et al. ..... 206/455
5,284,334 A * 2/1994 Yamamoto ..... 271/107
5,690,326 A * 11/1997 Ballerini et al. ..... 271/90
6,010,125 A * 1/2000 Nakajima ..... 271/11
6,095,514 A * 8/2000 Kudo et al. ..... 271/104

* cited by examiner

*Primary Examiner*—Donald P. Walsh
*Assistant Examiner*—Kaitlin Joerger
(74) *Attorney, Agent, or Firm*—Frishauf, Holtz, Goodman & Chick, P.C.

(57) ABSTRACT

The problem of the present invention is to clear the packaging material and the presence/absence detecting method of the residual photothermographic image recording sheet, which are improved so that the concave section or the notched section provided on the bottom plate does not exercise a bad influence, caused by the exhalation of the organic solvent, on the recording sheet stacked on the lowermost position. Packaging material of the recording sheets, having a detecting means of the recording sheet, wherein there is provided the concave section or the notched section on a section where a part of a vacuum head comes into contact with a bottom plate located on a bottom section of the packaging material, and wherein there is arranged a filler formed with a soft material having air permeability and neither absorbs nor transmits organic solvent, in the concave section or the notched section.

8 Claims, 5 Drawing Sheets

FIG. 3 ( A )
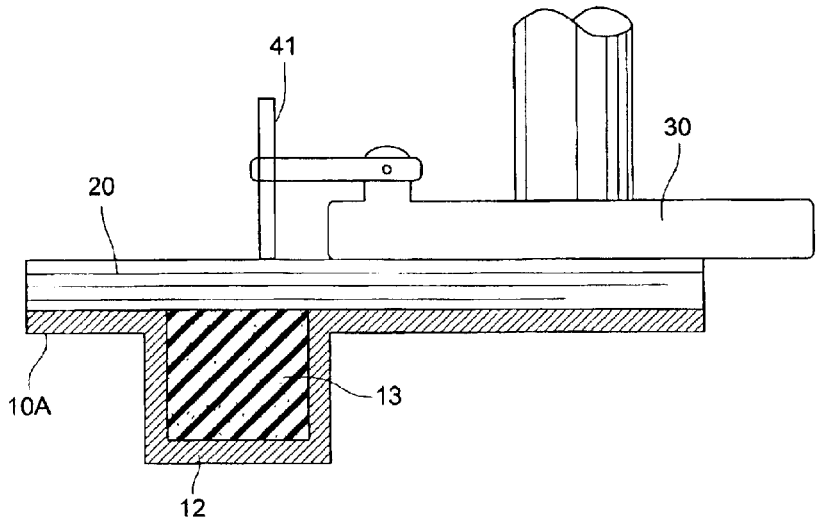
FIG. 3 ( B )
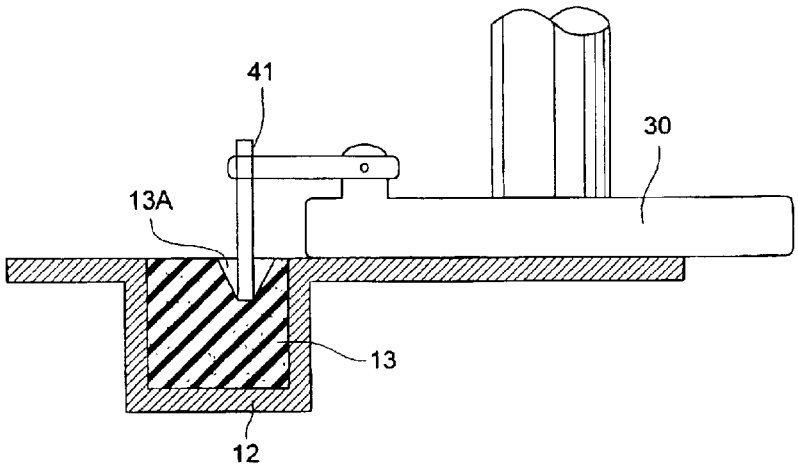

PACKAGING MATERIAL OF PHOTOTHERMOGRAPHIC IMAGE RECORDING SHEET AND DETECTING METHOD OF PRESENCE/ABSENCE OF RESIDUAL PHOTOTHERMOGRAPHIC IMAGE RECORDING SHEET

BACKGROUND OF THE INVENTION

The present invention relates to packaging material of photothermographic image recording sheets and a presence/absence detecting method for residual photothermographic image recording sheet, and in particular, to the photothermographic image recording sheet package used for preventing the generation of a scratch caused during the transportation and the generation of a chemical or physical change caused during the preservation, and the presence/absence detecting method of the residual photothermographic image recording sheet.

The photothermographic image recording sheets is shipped in a packaging style, as shown in FIG. 5, being packaged in moisture-proof bag 100 for an outer package in which they are contained to be a bundled condition, being held between strong protecting plates (hereinafter referred to as a bottom plate), which are formed by pulp base paper.

When the photothermographic image recording sheets are used, the photothermographic image recording sheets are taken out of the moisture-proof bag for the outer package, and the photothermographic image recording sheets contained by the packaging material including the bottom plate are set on a photothermographic apparatus. Each sheet of the set photothermographic image recording sheets is picked up by a mechanism using a vacuum head to be supplied to the apparatus. When the last photothermographic image recording sheet stacked on the lowermost position has been picked up, the vacuum head comes directly in contact with the upper surface of the bottom plate, and thereby, the sucking mechanism still remains working. Due to this, it is difficult to distinguish whether the photothermographic image recording sheet exists or not, which causes the malfunction of the apparatus.

In order to prevent the above-mentioned malfunction, there is used a structure wherein the concave section or the notched section (including a through hole) are provided on the bottom plate where the vacuum head acts, and the absence of the photothermographic image recording sheet is judged by detecting that the sucking mechanism does not work (Refer to JITSUKAISYOU 55-164642, JITSUKAISYOU 57-2522, JITSUKAISYOU 61-20591, JITSUKAIHEI 6-82975, JITSUKOUSYOU 61-4915, TOKUKOUSYOU 63-184752, PATENT 2679993 and TOKUKAI 2001-109112).

On the other hand, in the photothermographic image recording sheet which is different from the conventional general photographic photosensitive material, there is structure wherein the reducing agent and organic silver co-exist in a photosensitive layer of a film, and the reducing agent moves, when heated, to the side of the organic silver to give an electron for exposing, further, there is included an organic solvent which serves as a role of a medium when the reducing agent moves, however, when there is the concave section or the notched section (or the through hole) on the portion of the bottom plate, the organic solvent on the section where the enveloped photothermographic image recording sheet touches the concave section or the notched section evaporates, and the reducing agent hardly migrates on the section where the organic solvent evaporated, which causes the generation of trouble that the above-mentioned section is changed to be white without being exposed.

As cleared by the above description, in a structure of judging the presence/absence of the photothermographic image recording sheet by detecting sucking or non-sucking of the photothermographic image recording sheet by the vacuum head that picks up the photothermographic image recording sheet, the first subject of the present invention is to clear the packaging material of the photothermographic image recording sheet and presence/absence detecting method of the residual photothermographic image recording sheet, which are improved so that the concave section or the notched section provided on the bottom plate of the bottom section does not exercise a bad influence, caused by the exhalation of the organic solvent, on the photothermographic image recording sheet stacked at the lowermost position.

The second subject of the present invention is to clear the packaging material of the photothermographic image recording sheet and the presence/absence detecting method of the residual photothermographic image recording sheet which are improved so that the concave section or the notched section provided on the bottom plate does not exert a bad influence based on a clearing of the organic solvent to the photothermographic image recording sheet stacked on the lowermost position.

SUMMARY OF THE INVENTION

The present invention is structured as follows.

Structure 1. In the packaging material for the photothermographic image recording sheet in which the photothermographic image recording sheet, including at least one kind of non-photosensitive organic silver halide, a reducing agent for a silver ion and a binder on a support, is housed so that a surface including at least the non-photosensitive organic silver halide is brought into contact with a bottom section of the packaging material, the packaging material for the photothermographic image recording sheet is characterized in that, there is provided a detecting means of the photothermographic image recording sheet, wherein there is provided a concave section or a notched section on a section where a part of a vacuum head comes into contact with a bottom plate located on a bottom section of the packaging material, and wherein there is arranged a filler formed with a soft material having air permeability and neither absorbs nor transmits an organic solvent, on the concave section or the notched section.

Structure 2. In the packaging material for the photothermographic image recording sheet in which the photothermographic image recording sheet, including at least one kind of the non-photosensitive organic silver halide, a reducing agent for a silver ion and a binder on a support, is housed so that a surface including at least the non-photosensitive organic silver halide is brought into contact with a bottom section of the packaging material, a presence/absence detecting method for the residual photothermographic image recording sheets housed in the packaging material is characterized in that, the absence of the photothermographic image recording sheet is detected by air suction to a filler, wherein there is provided a concave section or a notched section on a section where a part of a vacuum head touches a bottom plate located on the bottom section of the packaging material, and wherein there is arranged the filler formed with a soft material having air permeability and neither absorbs nor transmits an organic solvent, in the concave section or the notched section.

Structure 3. In the packaging material for the photothermographic image recording sheet in which the photothermographic image recording sheet, including at least one kind of non-photosensitive organic silver halide, a reducing agent for a silver ion and a binder on a support, is housed so that a surface including at least the non-photosensitive organic silver halide is brought into contact with a bottom section of the packaging material, the packaging material for the photothermographic image recording sheet is characterized in that there is provided a detecting means of the photothermographic image recording sheet, wherein there is provided a concave section or a notched section on a section where a part of a vacuum head touches a bottom plate located in a bottom section of the packaging material, and wherein there is arranged a filler, formed with a soft material having air permeability and neither absorbs nor transmits an organic solvent, and which a film zero-detection pin penetrates, on the concave section or the notched section.

Structure 4. In the packaging material for the photothermographic image recording sheet in which the photothermographic image recording sheet, including at least one kind of non-photosensitive organic silver halide, a reducing agent for a silver ion and a binder on a support, is housed so that a surface including at least the non-photosensitive organic silver halide is brought into contact with a bottom section of the packaging material, a presence/absence detecting method for the residual photothermographic image recording sheet housed in the packaging material is characterized in that, the absence of the photothermographic image recording sheet is detected by the penetration of zero-detecting pin into a filler, wherein there is provided a concave section or a notched section on a section where a part of a vacuum head comes into contact with a bottom plate located on the bottom section of the packaging material, and wherein there is arranged the filler formed with a soft material having air permeability and neither absorbs nor transmits an organic solvent, in the concave section or the notched section.

Structure 5. In the packaging material for photothermographic image recording sheet in which the photothermographic image recording sheet, including at least one kind of non-photosensitive organic silver halide, a reducing agent for a silver ion and a binder on a support, is housed so that a surface including at least the non-photosensitive organic silver halide is brought into contact with a bottom section of the packaging material, the packaging material for the photothermographic image recording sheet is characterized in that, there is provided a detecting means for the photothermographic image recording sheet, wherein there is provided a concave section or a notched section where a part of a vacuum head comes into contact with a bottom plate on a bottom section of the packaging material, and wherein there is provided the filler formed with the soft material that neither absorbs nor transmits an organic solvent, on the concave section or the notched section, and which is deformed by pressure of film zero-detection pin.

Structure 6. In the packaging material for photothermographic image recording sheet in which the photothermographic image recording sheet, including at least one kind of non-photosensitive organic silver halide, a reducing agent for a silver ion and a binder on a support, is housed so that a surface including at least the non-photosensitive organic silver halide is brought into contact with a bottom section of the packaging material, a presence/absence detecting method of the residual photothermographic image recording sheet housed in the packaging material is characterized in that, an absence of the photothermographic image recording sheet is detected by the penetration of the zero-detecting pin into the filler, wherein there is provided a concave section or a notched section on a section where a part of a vacuum head of the bottom plate located on a bottom section of the packaging material, and wherein there is provided the filler formed with soft material that neither absorbs nor transmits an organic solvent, on the concave section or the notched section, and which is deformed by the pressure of a film zero-detecting pin.

Structure 7. The packaging material for the photothermographic image recording sheet described in the Structure 1, 3 or 5, wherein at least the bottom plate is formed with a thermoplastic resin sheet.

BRIEF DESCRIPTION OF THE DRAWINGS

FIG. 3 is an enlarged sectional view of the primary portion in the third embodiment of the present invention.

DETAILED DESCRIPTION OF THE PREFERRED EMBODIMENT

Figure 1:
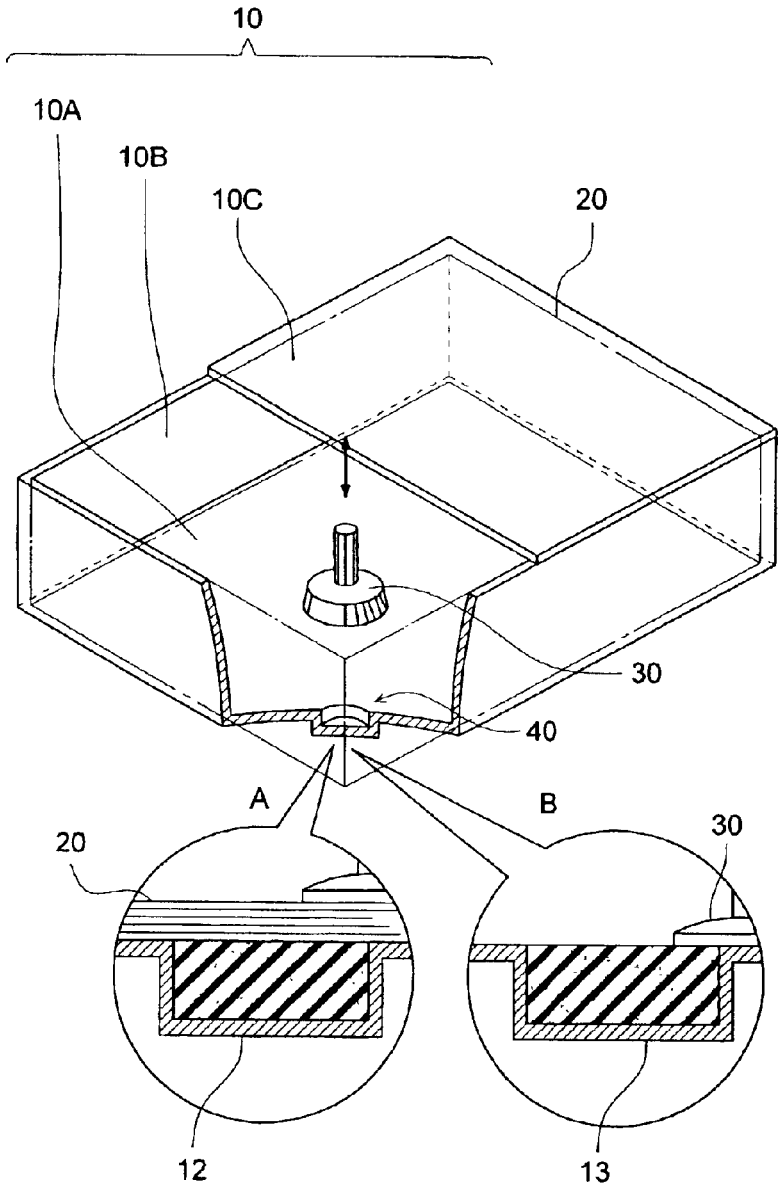
FIG. 1 is a perspective drawing showing the first embodiment of the present invention.

The embodiment shown in FIG. 1 is described as follows. Packaging material (or container) 10 formed in a cassette type is composed of bottom plate 10A, side wall plate 10B and cover 10C. In a loading step to a developing apparatus, a portion of the cover 10C is removed to be in an open condition, in order to pick up the photothermographic image recording sheet 20 stored in a stacked condition, and vacuum head 30 moves up and down through an open section to suck and take out the sheet stacked on the uppermost position to transport it. On a part of the bottom plate 10A, there is provided detecting means 40 for detecting presence/absence of the photothermographic image recording sheet 20. Partial enlarged drawing A shows the condition that the (lowermost) photothermographic image recording sheet 20 exists, while partial enlarged drawing B shows the condition that the (lowermost) photothermographic image recording sheet 20 does not exist.

The detecting means 40 of the embodiment shown in FIG. 1 has concave section 12 where a portion of the bottom plate 10A comes into contact with vacuum head 30, and filler 13 is arranged in this concave section 12. Incidentally, the upper surface of the filler 13 is structured so as to be in the same height as the upper surface of the bottom plate 10A.

The concave section 12 is formed to be in a round shape in the section in FIG. 1, however, it may also be in a cross-sectional shape of a square, a triangle or an ellipse, or other cross-sectional shapes, provided that a part of the shape comes into contact with the vacuum head 30. With respect to the preferable size of the concave section 12, in the case of cross-sectional form of a round shape, the diameter is 0.5 mm to 50 mm, and the depth is 0.1 mm to 3 mm.

To form the concave section 12, it is possible to adopt a manual work to stamp with a punch or a mechanical work to use a press machine.

Further, to arrange the filler 13, it is possible to adopt not only a method to insert the member prepared separately as a filler in the concave section 12 formed already by hand work or mechanical work, but also a method to inject unsolidified filling material in the previously formed concave section 12 to be solidified.

It is preferable that the upper surface of the filler 13 is flush with the upper surface of the bottom plate 10A, however both of them are not always required to be on the same plane strictly, and for example, an error of height in about ±1 mm is allowable.

Filler 13 has only to be a soft material having air permeability and neither absorbs or transmits organic solvent. For example, it is preferable that the filler 13 is a foaming plastic or a natural sponge representing a sponge material having therein an elasticity and including continuous foams having therein air, and further, preferably used is a non-woven fabric representing a plastic such as a polyester. If filler 13 is formed with soft material having permeability, as shown in partial enlarged drawing B, under the condition that the photothermographic image recording sheet 20 does not exist, the lower section of the vacuum head 30 is not closed and air is sucked by permeability of the filler 13, and due to this, a sucking power caused by a vacuum does not work for a long time, and it is impossible to detect the completion of the sucking. When the suction-impossible condition continues for a prescribed time, it is judged that the photothermographic image recording sheet 20 does not exist.

Figure 2:
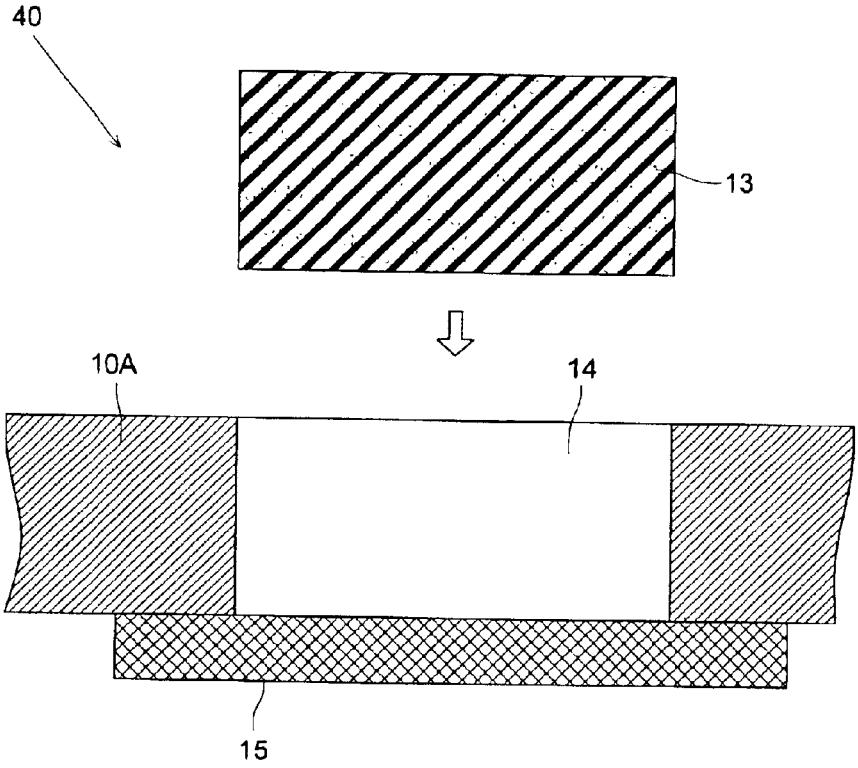
FIG. 2 is an enlarged sectional view of the primary portion in the second embodiment of the present invention.

The embodiment shown in FIG. 2 is described as follows. Instead of the concave section 12 provided on the bottom plate 10A shown in FIG. 1, this embodiment has a structure that the notched section 14 is provided on the bottom plate 10A, where the filler 13 is arranged to be reinforced by the bottom section holding member 15. This embodiment is performed by the method that the notched section 14 is formed by hand work or mechanical work, and the bottom section holding member 15 is pasted on the back side of the bottom plate 10A for the reinforcement, and the filler 13 is inserted in the notched section 14. The embodiment can be performed by the method that the filler 13 previously pasted on the prescribed position of the bottom section holding member 15 is inserted in the notched section 14 from the backside of the bottom plate 10A, or by the method that the unsolidified filling member is injected to be solidified in the notched section 14 in the condition that the bottom section holding member 15 is arranged.

The size or the plane form of the notched section 14 can be applied based on the embodiment described in FIG. 1. Further, the detection of presence/absence of the photothermographic image recording sheet 20 can be easily understood according to the explanation based on the partial enlarged drawing of FIG. 1.

Next, the embodiment shown in FIGS. 3(A) and 3(B) is described as follows. This embodiment has structure that pressing pin 41 moves up and down to come into contact with the portion of the filler 13 of the detecting means 40 shown in FIG. 1, and presence/absence of the photothermographic image recording sheet is detected by the contact pressure. Incidentally, the position where the concave section 12 is provided can be the position near the section with which the vacuum head 30 comes into contact.

In FIG. 3(A), since the photothermographic image recording sheet 20 is present, a tip of the pressing pin 41 which is going down comes into contact with the upper surface (or a second side surface) of the photothermographic image recording sheet 20, and stops going down farther. Further, in FIG. 3(B), since there is not the photothermographic image recording sheet 20, the tip of the pressing pin 41 falls deforming the filler 13 shown in penetrated section 13A, and the whole of the pressing pin 41 goes down by a certain depth deeper than the condition shown in FIG. 3(A).

As shown in FIGS. 3(A) and 3(B), when there is used the structure wherein the holding section of the pressing pin 41 is fixed to the vacuum head 30 and a moving amount (falling amount) of the pressing pin 41 from the position of the vacuum head 30 is measured, presence/absence of the photothermographic image recording sheet 20 can be detected by the detection of an amount of further falling (or non-falling amount) of the pressing pin 41 from the position where the lower surface of the vacuum head 30 touches the upper surface of the photothermographic image recording sheet 20. Various designs can be applied for the detecting method of the falling amount of (the tip of) the pressing pin 41.

The material of the filler 13 in the embodiment shown in FIGS. 3(A) and 3(B) is different naturally from the material in the embodiment shown in FIGS. 1 and 2. Air permeability is not an indispensable element at least, but indispensable is softness of the filler which allows the tip of the pressing pin 41 to penetrate by the prescribed depth (including the case of bending by the detectable amount. Such materials as plastic having the independent foams and an oil-repellent cloth are preferably used.

The size and the adoptable sectional shape of the concave section 12 in the embodiment shown in FIGS. 3(A) and 3(B) can be obtained experimentally in accordance with the material of the filler 13, and the sectional shape can be either the one corresponding to the sectional shape of the pressing pin 41, or the one not corresponding to the sectional shape of the pressing pin 41. The size of the concave section 12 naturally needs to be greater than the section of (at least the tip of) the pressing pin 41.

It is needless to say that the embodiment shown in FIGS. 3(A) and 3(B) can be performed by being coupled with the detecting means 40 having the structure shown in FIG. 2.

Figure 4:
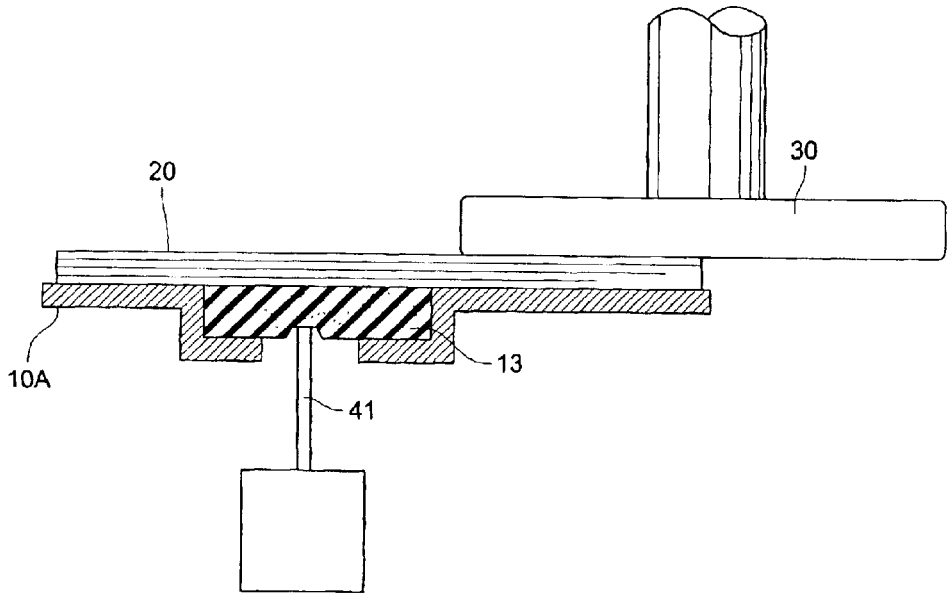
FIG. 4 is an enlarged sectional view of the primary portion in the fourth embodiment of the present invention.
Figure 4:
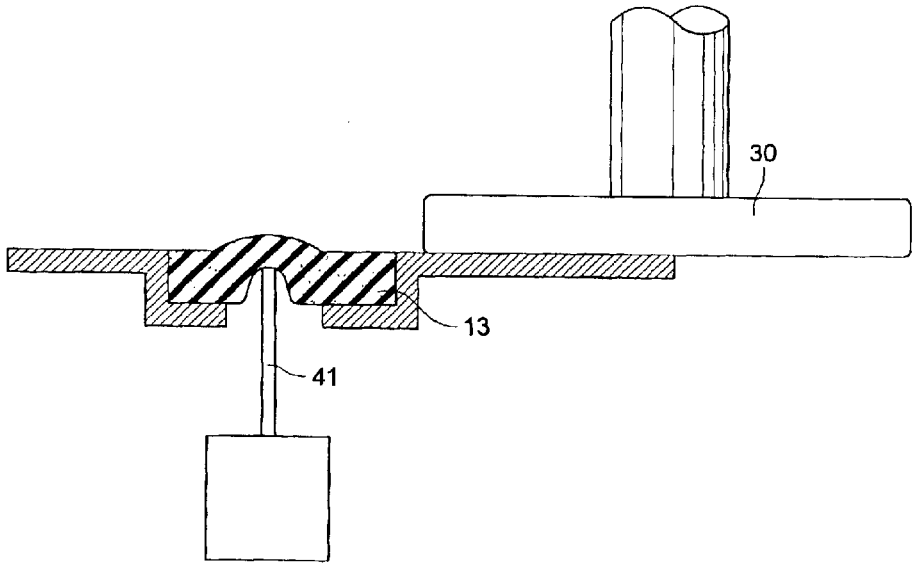
Figure 5:
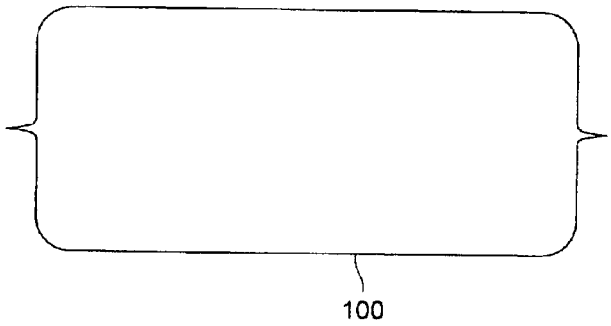
FIG. 5 is a schematic diagram of the moisture-proof bag.

The embodiment shown in FIG. 4 is described as follows. This embodiment is the one wherein the pressing pin 41 is driven upward from the bottom. When the photothermographic image recording sheet 20 exists, only a part of the touching portion of the filler 13 is deformed and the whole of the filler 13 is not deformed, even when the force is applied in the direction that the filler 13 is pushed up by the tip of the pressing pin 41, as shown in FIG. 4(A). Further, when the photothermographic image recording sheet does not exist, the filler 13 is pushed up by the tip of the pressing pin 41 to be deformed greatly, as shown in FIG. 4(B).

In the above-mentioned embodiment, at the step that the vacuum head 30 has been fallen, the presence/absence of the photothermographic image recording sheet 20 can be distinguished by the detection of the moving amount caused by the pushing-up operation of the pressing pin 41, further, by urging upwardly the pressing pin 41 from the fixed position by a spring, the presence/absence of the photothermographic image recording sheet 20 can be distinguished through the detection of the penetration amount of the pressing pin 41, including the case of a small deformation of the filler 13 and the case of a large deformation of the filler 13.

Following is a description of the material for forming the packaging material (or container) 10 structuring the bottom plate. The packaging material (or container) 10 for structuring the bottom plate, or at least, the bottom plate 10A is formed by the thermoplastic resin sheet. By structuring as mentioned above, an organic solvent existing in the photosensitive layer is not moved, even when the photosensitive surface of the photothermographic image recording sheet 20 is brought into contact with the bottom plate 10A.

As the thermoplastic resin sheet which can be preferably used, there are laminated products including polypropylene (preferably, biaxially oriented polypropylene), polyethylene (preferably, high-density polyethylene), polystyrene (preferably, having impact resistance), ABS (acrylonitrile-butadiene-styrene), and polyester, which have excellent barrier characteristics and abrasion resistant characteristics.

The packaging material relating to the present invention is the one for packaging a bundle of the photothermographic image recording sheets, and in particular, is the packaging material of a bundle of the photothermographic image recording sheets which contain the photothermographic image recording materials containing at least one kind of non-photosensitive organic silver halide, a reducing agent for a silver ion and a binder on the support, in a way that a first side surface including at least the non-photosensitive organic silver halide is brought into contact with a bottom section of the packaging material.

Following is the description of the photothermographic image recording sheet.

Employed as the photothermographic image recording material of the present invention may be conventional photothermographic image recording materials known in the prior art without any particular limitations. Representative examples are shown below.

In the present invention, organic silver salts are reducible silver sources, and are preferably silver salts of organic acids and hetero-organic acids, especially silver salts of aliphatic carboxylic acids having a long chain (having from 10 to 30 carbon atoms, and preferably from 15 to 25 carbon atoms) as well as nitrogen atom containing heterocyclic ring compounds. Organic or inorganic complexes are also preferred in which the ligands exhibit a total stability constant of 4.0 to 10.0 with respect to their silver ions. Listed as examples of such suitable silver salts are the following, described in Research Disclosure Items 17029 and 29963.

Silver salts of organic acids include, for example, silver salts of gallic acid, oxalic acid, stearic acid, arachidic acid, palmitic acid, and lauric acid; carboxylalkylthiourea salts of silver include, for example, silver salts of 1-(3-carboxypropyl)thiourea and 1-(3-caroxypropyl)-3,3-dimethylthiourea; silver salts and complexes of polymer reaction products of aldehyde and hydroxy aromatic carboxylic acids include, for example, silver salts and complexes of reaction products of aldehydes (such as formaldehyde, acetaldehyde, and butylaldehyde), and hydroxy substituted acids (such as salicylic acid, benzoic acid, 3,5-dihydroxybenzoic acid, and 5,5-thiodisalicylic acid); silver salts or complexes of thiones include, for example, silver salts or complexes of 3-(2-carboxyethyl)-4-hydroxymethyl-4-thiazoline and 3-carboxymethyl-4-thiazoline-2-thione; complexes or salts of silver with nitrogen acids selected from the group consisting of imidazole, pyrazole, urazole, 1,2,4-thiazole, 1H-tetrazole, 3-amino-5-benzylthio-1,2,4-triazole, and benzotriazole; and silver salts of saccharine and 5-chlorosalycylaldoxime; silver salts of mercaptides. Of these, listed as preferred silver salts is silver behenate, silver arachidate, or silver stearate.

Organic silver salts are prepared by mixing water-soluble silver compounds with compounds which form complexes with silver. Preferably employed as mixing methods are a normal mixing method, a reverse mixing method, a double jet mixing method, and a controlled double jet method, as described in Japanese Patent Publication Open to Public Inspection No. 9-127643. For example, a metal salt soap (for example, sodium behenate and sodium arachidate) is prepared by adding an inorganic alkali metal (for example, sodium hydroxide or potassium hydroxide) to an organic acid. Thereafter, organic silver salt crystals are prepared by mixing said soap and silver nitrate, employing said controlled double jet method. During such operation, silver halide grains may be mixed with said organic silver salt crystals.

In the present invention, the average diameter of said organic silver salt grains is preferably less than or equal to 2 $\mu$m, and said organic silver salt grains are preferably monodispersed. The average diameter of said organic silver salt grains, as described herein, refers to the diameter of the sphere which has the same volume as the grain, when grains are shaped to be, for example, semi-spherical, rod-like or planar. The average grain diameter is more preferably from 0.05 to 1.50 $\mu$m, and is most preferably from 0.05 to 1.00 $\mu$m. Further, the monodispersion, as described herein, is the same as defined for silver halide grains, and the degree of monodispersion is preferably from 1 to 30.

Still further, in the present invention, the proportion of planar grains in the total grains of said organic silver salt is preferably at least 60 percent. The planar grain, as described in the present invention, refers to the grain which has a ratio of the average grain diameter to the thickness, that is a so-called aspect ratio (hereinafter referred to as AR), represented by the formula described below, of at least 3.

$$AR = \text{average grain diameter (in } \mu\text{m)/thickness (in } \mu\text{m)}$$

It is possible to prepare organic silver salt grains having the shape specified as above by disperse-pulverizing said organic silver crystals together with binders as well as surface active agents, employing a ball mill and the like. By shaping the grains so as to be in the specified range, it is possible to prepare a light-sensitive material which exhibits high density as well as excellent image retention properties.

In the present invention, in order to maintain the desired transparency of the light-sensitive materials, the total silver amount of silver halide and organic silver salts is preferably from 0.5 to 2.2 g per $m^2$. By adjusting the silver amount to said range, it is possible to produce high contrast images. Further, the weight ratio of silver halide to total silver is commonly at most 50 percent, is preferably at most 25 percent, and is more preferably from 0.1 to 15.0 percent.

Listed as reducing agents, which are employed in the photothermographic image recording materials of the present invention, are those generally known in the art. Listed as said reducing agents are, for example, phenols, polyphenols having at least two phenol groups, naphthols, bisnaphthols, polyhydroxybenzenes having at least two hydroxyl groups, polyhydroxynaphthalenes having at least two hydroxyl groups, ascorbic acids, 3-pyrazolidones, pyrazoline-5-ones, pyrazolines, phenylenediamines, hydroxylamines, hydroquinone monoethers, hydroxamic acids, hydrazides, amidoximes, and N-hydroxyureas. More specifically, listed are reducing agents which are specifically exemplified in, for example, U.S. Pat. Nos. 3,615,533, 3,679,426, 3,672,904, 3,751,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent No. 1,486,148; Belgian Patent No. 786,086; Japanese Patent Publication Open to Public Inspection Nos. 50-36143, 50-36110, 50-116023, 50-99719, 50-140113, 51-51933, 51-23721, and 52-84727; and Japanese Patent Publication No. 51-35851. In the present invention, it is possible to use optimal reducing agents which are selected from those listed above. The most convenient selection method is as follows. Photothermographic image recording materials are practically prepared employing any of said reducing agents. Subsequently, by evaluating photographic characteristics of the resultant materials, advantages and disadvantages of the employed reducing agents are examined.

Of the aforesaid reducing agents, when aliphatic carboxylic acid silver salts are employed as an organic silver salt, listed as preferred reducible agents may be polyphenols in which at least two phenol groups are linked via an alkylene group or sulfur, especially polyphenols in which at least two phenol groups, which are substituted with an alkyl group (for example, a methyl group, an ethyl group, a propyl group, a t-butyl group, and a cyclohexyl group) or an acyl group (for example, an acetyl group and a propionyl group) at at least one position adjacent to the hydroxy substitution position of the phenol group, are linked via an alkylene group or sulfur, such as 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3-5-di-t-butylphenyl)methane, (2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-terakis(2-hydroxy-3,5-dimethylphenyl)-2,4-ethylpentane, 2,2-bis(4-hydroxy-3,5-dimethylphenyl)propane, and 2,2-bis(4-hydroxy-3,5-di-t-butylphenyl)propane, which are described in U.S. Pat. Nos. 3,589,903 and 4,021,249; British Patent No. 1,486,148; Japanese Patent Publication Open to Public Inspection Nos. 51-51933, 50-36110, 50-116023, 52-84727, and Japanese Patent Publication No. 51-35727; bisnaphthols such as 2,2'-dihydroxy-1,1'-binaphtyl, 6,6'-dibromo-2,2'-dihydroxy-1,1'-binaphtyl, 6,6'-dinitro-2,2'-dihydroxy-1,1'-binaphtyl, bis(2-hydroxy-1-naphtyl)methane, and 4,4'-dimethoxy-1,1'-dihydroxy-2,2'-binaphtyl, described in U.S. Pat. No. 3,672,904; and in addition, sulfonamidophenols or sulfoamidonaphthols such as 4-benzenesulfonamidophenol, 2-benzenesulfonamidophenol, 2,6-dichloro-4-benzenesulfonamidophenol, and 4-benzenesulfonamidonaphthol, described in U.S. Pat. No. 3,801,321.

The amount of reducing agents employed in the photothermographic image recording materials of the present invention varies depending on the types of organic silver salts as well as the types of reducing and other additives. However, said amount is commonly from 0.05 to 10.00 mol per mol of the organic silver salt, and is preferably from 0.1 to 3.0 mol. Further, in said range, the aforesaid reducing agents may be employed in combinations of at least two types.

In the photothermographic image recording materials of the present invention, it is preferable that additives, which are called tone modifiers, tone providing agents, or image toners (hereinafter referred to as tone modifiers), are employed together with components listed above. Said tone modifiers are involved in the oxidation-reduction reaction between the organic silver salts and the reducing agents so that the resultant silver images result in a deep color, especially black.

Suitable tone modifiers employed in the present invention are disclosed in Research Disclosure Item 17020 and include the following:

Imides (for example, phthalimide); cyclic imides; pyrazoline-5-ones and quinazolines (for example, succinimide, 3-phenyl-2-pyrazoline-5-one, 1-phenylurazole, quinazoline, and 2,4-thiazoline-dione); naphthalimides (for example, N-hydroxy-1,8-napthalimide); cobalt complexes (for example, hexaaminetrifluoroacetatocobalt); mercaptans (for example, 3-mercapto-1,2,4-triazole); N-(aminomethyl)-aryldicarboxyimides (for example, N-(dimethylaminomethyl) phthalimide; blocked pyrazoles; isothiuronium derivatives and combinations thereof with certain types of light bleaching agents (for example, the combination of N,N'-hexamethylenebis(1-carbamoyl-3,5-dimethylpyrazole and 1,8-(3,6-dioxaoctane)bis(isothiuroniumtrifluoroacetate) and 2-(tribromomethylsulfonyl)benzothiazole); phthalazinone, derivatives thereof, and metal salts of said derivatives (for example, a combination of 4-(1-naphthyl)phthalazinone, 6-chlorophthalazinone, 5,7-dimethoxyphthalazinone, and 2,3-dihydro-1,4-phthalozinedione); combinations of phthalazinone and sulfinic acid derivatives (for example, 6-chlorophthalazinone and sodium benzenesulfinate, or 8-methylphthalazinone and sodium p-tolylsulfinate), combinations of phthalazinone and phthalic acid; combinations of phthalazine (including addition products of phthalazine and maleic anhydrides) and at least one compound selected from the group consisting of phthalic acid, 2,3-naphthalenedicarboxylic acid, or o-phenylenic acid derivatives and anhydrides thereof (for example, phthalic acid, 4-methylphthalic acid, 4-nitrophthalic acid, and tetrachlorophthalic anhydride); quinazolinediones; benzoxazine or naphthoxazine derivatives; benzoxazine-2,4-diones (for example, 1,3-benzoxazine-2,4-dione, pyrimidines and asymmetric triazines (for example, 2,4-dihydroxypyrimidine); and tetraazapentalene derivatives (for example, 3,6-dimercapto-1,4-diphenyl-1H,4H-2,3a,5,6a-tatraazapentalene).

Further listed are the following compounds. Listed as preferred toner modifiers are phthalazinone derivatives or phthalazine derivatives.

Binders, which are suitable for photothermographic image recording materials of the present invention may be transparent, or translucent and commonly colorless, and include natural polymers, synthetic polymers, and copolymers, and in addition, film forming media such as gelatin, gum arabic, polyvinyl alcohol, hydroxyethyl cellulose, cellulose acetate, cellulose acetate butyrate, polyvinylpyrrolidone, casein, starch, polyacrylic acid, polymethyl methacrylate, polymethacrylic acid, polyvinyl chloride, copoly(styrene-maleic anhydride), copoly(styrene-acrylonitrile), copoly(styrene-butadiene), polyvinyl acetal such as polyvinyl formal, polyvinyl butyral, polyesters, polyurethanes, phenoxy resins, polyvinyl vinylidene chloride, polyepoxides, polycarbonates, polyvinyl acetate, cellulose esters, and polyamides. They may be hydrophilic or hydrophobic. However, of the binders listed above, most preferred are non-water-soluble polymers such as cellulose acetates, cellulose acetate butyrate, and polyvinyl butyral. Of these, most preferred is polyvinyl butyral.

In the present invention, the binder amount of the light-sensitive layer is preferably from 1.5 to 6.0 g/m$^2$, and is more preferably from 1.7 to 5.0 g/m$^2$. When said amount is less than 1.5 g/m$^2$, the resulting products are occasionally not commercially viable due to a marked increase in the density of unexposed areas.

In the present invention, matting agents are preferably incorporated on the light-sensitive layer side, and in order to minimize abrasion after thermal development, said matting agents are preferably arranged on the surface of light-sensitive materials. Said matting agents are preferably incorporated in an amount of 0.5 to 30.0 percent by weight with respect to the total binders on the light-sensitive layer side.

Further, when non-light-sensitive layers are provided on the side opposite to the support of the light-sensitive layer, it is preferable that said matting agents are incorporated in at least one layer on the non-light-sensitive layer side. Further, in order to optimize slippage properties of light-sensitive materials as well as to minimize fingerprints on the surface of the light-sensitive layer, it is preferable that matting agents be arranged on the surface of said light-sensitive materials. Further it is preferable that said matting agents be incorporated in an amount of 0.5 to 40.0 percent by weight with respect to the total binders in layers on the side opposite to the side of the light-sensitive layer.

Materials of the matting agents, employed in the present invention, may be either organic or inorganic. For example, employed as inorganic materials may be silica described in Swiss Patent No. 330,158, glass powder described in French Patent No. 1,296,995, and carbonates of alkaline earth metals, cadmium, and zinc. Employed as organic materials may be starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, polyacrylonitrile described in U.S. Pat. No. 3,079,247, and polycarbonate described in U.S. Pat. No. 3,022,169.

The shape of said matting agent particles may be either regular or irregular. However, regular shapes are preferred and a spherical shape is preferably employed. The size of matting agent particles is commonly represented by the diameter of a sphere which has the same volume as the matting agent particle. The diameter of matting agent particles, as described in the present invention, refers to said sphere equivalent diameter.

The average diameter of the matting agent particles employed in the present invention is preferably from 0.5 to 10.0 $\mu$m, and is more preferably from 1.0 to 8.0 $\mu$m. Further, the variation coefficient of the particle size distribution is preferably 50 percent or less, and is more preferably 30 percent or less.

Herein, the variation coefficient of the particle size distribution is the value represented by the formula given below:

(Standard deviation of particle diameter)/(average of particle diameter)×100

The matting agents, employed in the present invention, may be incorporated in any of the constitution layers. However, in order to achieve the objectives of the present invention, said matting agents are preferably incorporated in any of the constitution layers other than the light-sensitive layer, and are more preferably incorporated into the outermost layer from the support.

Addition methods of said matting agents, employed in the present invention, include one in which matting agents are previously dispersed into a coating composition, and the resultant coating composition is applied to coating, and, another method in which after coating a coating composition, matting agents are sprayed onto the resultant coating prior to the completion of drying. Further, when a plurality of types of matting agents is added, both methods, described above, may be employed in combination.

When the photothermographic image recording materials of the present invention are used as output of an image setter having an oscillating wavelength especially from 700 to 850 nm, it is preferable that hydrazine compounds are incorporated in said light-sensitive materials. Listed as preferred hydrazine compounds employed in the present invention may be compounds described in Research Disclosure Item 23515 (page 346, November 1983) and references cited therein; and in addition, in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; British Patent No. 2,011,391; European Patent Nos. 217,310, 301,799, and 356,898; Japanese Patent Publication Open to Public Inspection Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164.

In addition to compounds listed above, employed may be compounds specifically described on pages 3 and 4 which are represented by (Ka 1), described in Japanese Patent Publication No. 6-77138; compounds 1 through 38 specifically described on pages 8 through 18, which are represented by General Formula (1), described in Japanese Patent Publication No. 6-93082; compounds 4-1 through 4-10, specifically described on pages 25 and 26, compounds 5-1 through 5-42, specifically described on pages 28 through 36, and compounds 6-1 through 6-7, specifically described on pages 39 and 40, which are represented by General Formulas (4), (5), and (6), described in Japanese Patent Publication Open to Public Inspection No. 6-23049; compounds 1-1) through 1-17) and 2-1) on pages 5 through 7, which are represented by General Formulas (1) and (2), described in Japanese Patent Publication Open to Public Inspection No. 6-289520; compounds specifically described on pages 6 through 19, represented by (Ka 2) and (Ka 3), described in Japanese Patent Publication Open to Public Inspection No. 6-313936; compounds specifically described on pages 3 through 5, which are represented by (Ka 1), described in Japanese Patent Publication Open to Public Inspection No. 6-313951; compounds I-1 through I-38 specifically described on pages 5 through 10, represented by General Formula (I), which are described in Japanese Patent Publication Open to Public Inspection No. 7-5610; and compounds II-1 through II-103 specifically described on pages 10 through 27, which are represented by General Formula (II), described in Japanese Patent Publication Open to Public Inspection No. 7-77783; and compounds H-1 through H-44 specifically described on pages 8 through 15, which are represented by General Formulas (H) and (Ha), described in Japanese Patent Publication Open to Public Inspection No. 7-104426.

Photothermographic image recording materials of the present invention are stable at room temperature, but are developed upon being heated to a relatively high temperature after exposure. The heating temperature is preferably from 80 to 200° C., and is more preferably from 100 to 150° C. When the heating temperature is less than or equal to 80° C., sufficient image density is not obtained over a short period of time. On the other hand, when said heating temperature is at least 200° C., binders melt, resulting in transfer of melted binders onto the rollers. As a result, images, as well as transportability and the processor, are adversely affected.

Upon heating said photothermographic image recording material, silver images are formed utilizing an oxidation-reduction reaction between organic silver salts (which function as an oxidizing agent) and the reducing agents. Said reaction proceeds without exterior supply of any processing solution such as water.

The photothermographic image recording material of the present invention comprises a support having thereon at least one light-sensitive layer. On said support, only a single light-sensitive layer may exist. However, it is preferable that at least one non-light-sensitive layer is applied onto said light-sensitive layer.

Representative examples of photothermographic image recording materials have been described. However, the photothermographic image recording materials are not limited to these examples and may be any of examples listed in the prior art.

In the conventional structure provided simply with the concave section or the notched section on the bottom plate, the photothermographic image recording sheet which comes into contact with the concave section or the notched section is adversely affected by the organic solvent, however, in the present invention, by arranging the filler relating to the present invention in the concave section or the notched section, the invention has an advantage that the photothermographic image recording material which comes into contact with these sections is not affected adversely by the organic solvent.

What is claimed is:

1. A photothermographic image recording sheet package, comprising:

a bundle of photothermograhic image recording sheets, where each photothermographic image recording sheet has a first side surface covered with a photothermographic image recording material containing an organic solvent and a second side surface; and a container for preventing a scratch caused during transportation and a chemical or physical change caused during preservation, including a bottom plate and a side wall plate; and a bag in which the bundle of photothermographic image recording sheets and the container are packaged;

wherein the bundle of photothermographic image recording sheets is placed on the bottom plate in such a way that the first side surface of a lowermost photothermographic image recording sheet comes in contact with the bottom plate, and wherein the bottom plate has a concave section filled with a filler formed of a soft material which has air permeability and neither absorbs nor transmits the organic solvent contained in the photothermographic image recording material.

2. The photothermographic image recording sheet package of claim 1, wherein the cancave section is shaped in a through hole.

3. The photothermographic image recording sheet package of claim 1, wherein the concave section is shaped in a notched section.

4. The photothermographic image recording sheet package of claim 1, wherein the bottom plate is made of a thermoplastic resin sheet.

5. A method for detecting absence of a photothermographic image recording sheet in a container, wherein a photothermagraphic image recording sheet has a first side surface covered with a photothermographic image recording material containing an organic solvent and a second side surface and a bundle of photothermographic image recording sheets is placed on a bottom plate of the container in such a way that the first side surface of a lowermost photothermographic image recording sheet comes in contact with the bottom plate and wherein the bottom plate has a concave section filled with a filler formed of a soft material which has air permeability and neither absorbs nor transmits the organic solvent contained in the photothermographic image recording material, the method comprising steps of:

picking up an uppermost photothermographic image recording sheet by sucking the second side of the uppermost photothermographic image recording sheet with a vacuum head;

pressing the second side of the uppermost photothermographic image recording sheet with a pressing pin; and detecting absence of a photothermographic image recording sheet in the container from a positional change of the pressing pin between a case that pressing pin presses the second side of the uppermost photothermographic image recording sheet and a case that the pressing pin presses the soft material in the concave section.

6. An apparatus for detecting absence of a photothermographic image recording sheet in a container, wherein a photothermographic image recording sheet has a first side surface covered with a photothermographic image recording material containing an organic solvent and a second side surface and a bundle of photothermographic image recording sheets is placed on a bottom plate of the container in such a way that the first side surface of a lowermost photothermographic image recording sheet comes in contact with the bottom plate and wherein the bottom plate has a concave section filled with a filler formed of a soft material which has air permeability and neither absorbs nor transmits the organic solvent contained in the photothermographic image recording material, comprising:

a vacuum head for picking up an uppermost photothermographic image recording sheet by sucking the second side of the uppermost photothermographic image recording sheet;

a pressing pin for pressing the second side of the uppermost photothermographic image recording sheet; and a detecting device for detecting absence of a photothermographic image recording sheet in the container from a positional change of the pressing pin between a case that the pressing pin presses the second side of the uppermost photothermographic image recording sheet and a case that the pressing pin presses the soft material in the cancave section.

7. A method for detecting absence of a photothermographic image recording sheet in a sheet in a container, wherein a photothermographic image recording sheet has a first side surface covered with a photothermographic image recording material containing an organic solvent and a second side surface, comprising steps of:

loading a bundle of photothermographic image recording sheets placed on the container onto a pick up device, wherein the bundle of photothermographic image recoding sheets and the container are taken out from a bag in which the bundle of photothermographic image recording sheets is placed on a bottom plate of the container in such a way that the first side surface of a lowermost photothermographic image recording sheet comes in contact with the bottom plate and the bottom plate has a concave section filled with a filler formed of a soft material which has air permeability and neither absorbs nor transmits the organic solvent contained in the photothermographic image recording material;

picking up an uppermost photothermographic image recording sheet by sucking the second side of the uppermost photothermographic image recording sheet with a vacuum head of the pick up device; and detecting absence of a photothermographic image recording sheet in the container from a vacuum change of the vacuum head between a case that the vacuum head sucks the second side of the uppermost photothermographic image recording sheet and a case that the vacuum head sucks the soft material in the concave section.

8. An apparatus of detecting absence of a photothermographic image recording sheet in a container, wherein a photothermographic image recording sheet has a first side surface covered with a photothermographic image recording material containing an organic solvent and a second side surface and a bundle of photothermographic image recording sheets is placed on a bottom plate of the container in such a way that the first side surface of a lowermost photothermographic image recording sheet comes in contact with the bottom plate and wherein the bottom plate has a concave section filled with a filler formed of a soft material which has air permeability and neither absorbs nor transmit the organic solvent contained in the photothermographic image recording material, comprising:

a vacuum head for picking up an uppermost photothermographic image recording sheet by sucking the second side of the uppermost photothermographic image recording sheet; and a detecting device for detecting absence of a photothermographic image recording sheet in the container from a vacuum change of the vacuum head between a case that the vacuum head sucks the second side of the uppermost photothermographic image recording sheet and a case that the vacuum head sucks the soft material in the concave section.

* * * * *